United States Patent [19]

Marcroft

[11] Patent Number: 4,491,213

[45] Date of Patent: Jan. 1, 1985

[54] COIN MECHANISM FOR VENDING MACHINE

[75] Inventor: Brian J. Marcroft, Norwalk, Calif.

[73] Assignee: Times Mirror Company, Los Angeles, Calif.

[21] Appl. No.: 351,136

[22] Filed: Feb. 22, 1982

Related U.S. Application Data

[63] Continuation-in-part of Ser. No. 325,724, Nov. 30, 1981, abandoned.

[51] Int. Cl.[3] ..... G07F 1/04

[52] U.S. Cl. ..... 194/1 D; 194/1 K

[58] Field of Search ..... 194/1 D, 1 G, 1 K, 54, 194/59, 71, DIG. 2, 101

[56] References Cited

U.S. PATENT DOCUMENTS 2,000,462 5/1935 Brodd ..... 194/101 X 3,870,136 3/1975 Voegeli ..... 194/1 D X 3,884,330 5/1975 Chalabian ..... 194/59

*Primary Examiner*—F. J. Bartuska

*Attorney, Agent, or Firm*—Christie, Parker & Hale

[57] ABSTRACT

A single leaf spring serves to bias a coin chute and an actuating lever of a coin mechanism. The coin mechanism has a stationary frame. A pair of coin chutes are pivotally mounted on the frame so the chutes open in one direction and close in the other direction. An actuating lever is pivotally mounted on the frame such that it pivots in one direction to engage and open the chutes and pivots in the other direction to disengage the chutes. One spring biases one of the chutes in the other direction to urge the one chute to close. Another spring extends between the other chute and the actuating lever to bias the other chute in the other direction and to bias the actuating lever in the other direction.

14 Claims, 6 Drawing Figures

COIN MECHANISM FOR VENDING MACHINE

CROSS REFERENCE TO RELATED APPLICATIONS

This is a continuation-in-part of application Ser. No. 325,724, filed on Nov. 30, 1981 now abandoned.

BACKGROUND OF THE INVENTION

This invention relates to vending machines and, more particularly, to a coin mechanism for a vending machine such as a newsrack.

Chalabian U.S. Pat. No. 3,884,330 discloses a coin mechanism used in a newspaper vending machine, commonly called a newsrack. The coin mechanism has a frame on which a pair of coil chutes are pivotally mounted. The chutes pivot open in one direction and closed in the other direction. A coil spring is connected between brackets secured to the chutes, to bias the chutes closed. An actuating lever is also pivotally mounted on the frame such that it pivots in one direction to engage and open the chutes and pivots in the other direction to disengage the chutes. A leaf spring biases the actuating lever in the direction to close the chutes. The newsrack has a newspaper access door on which a latch is mounted. In the absence of proper coinage in the coin chutes, the latch engages the actuating lever and pivots it in the one direction as the access door is pulled, thereby opening the chutes and delivering the coins therein to a coin return receptacle without unlocking the door. In the presence of proper coinage in the coin chutes, the latch is pivoted by the bottom coin in one of the chutes so as to avoid the actuating lever as the door is pulled, thereby unlocking the door and permitting it to be opened. Over a period of time, the coil spring tends to stretch and lose its ability to close the chutes, which leads to jamming of the coins in the mechanism.

SUMMARY OF THE INVENTION

According to the invention, a single spring, preferably a leaf spring, serves to bias a coin chute and an actuating lever of a coin mechanism. Specifically, a coin mechanism has a stationary frame. A pair of coin chutes are pivotally mounted on the frame so the chutes open in one direction and close in the other direction. An actuating lever is pivotally mounted on the frame such that it pivots in one direction to engage and open the chutes and pivots in the other direction to disengage the chutes. One spring biases one of the chutes in the other direction to urge the one chute to close. Another spring extends between the other chute and the actuating lever to bias the other chute in the other direction and to bias the actuating lever in the other direction. Preferably, both springs are leaf springs, cut for example from a coiled length of blue clock spring. In addition to structurally simplifying the coin mechanism, the springs provide a more positive closing action than a coil spring over a period of time.

A feature of the invention is the use of leaf springs arranged so both ends apply closure force to the respective coin chutes, thereby providing a more positive chute closing action.

BRIEF DESCRIPTION OF THE DRAWINGS

The features of a specific embodiment of the best mode contemplated for carrying out the invention are illustrated in the drawings, in which.

DETAILED DESCRIPTION OF THE SPECIFIC EMBODIMENT

Figure 1:
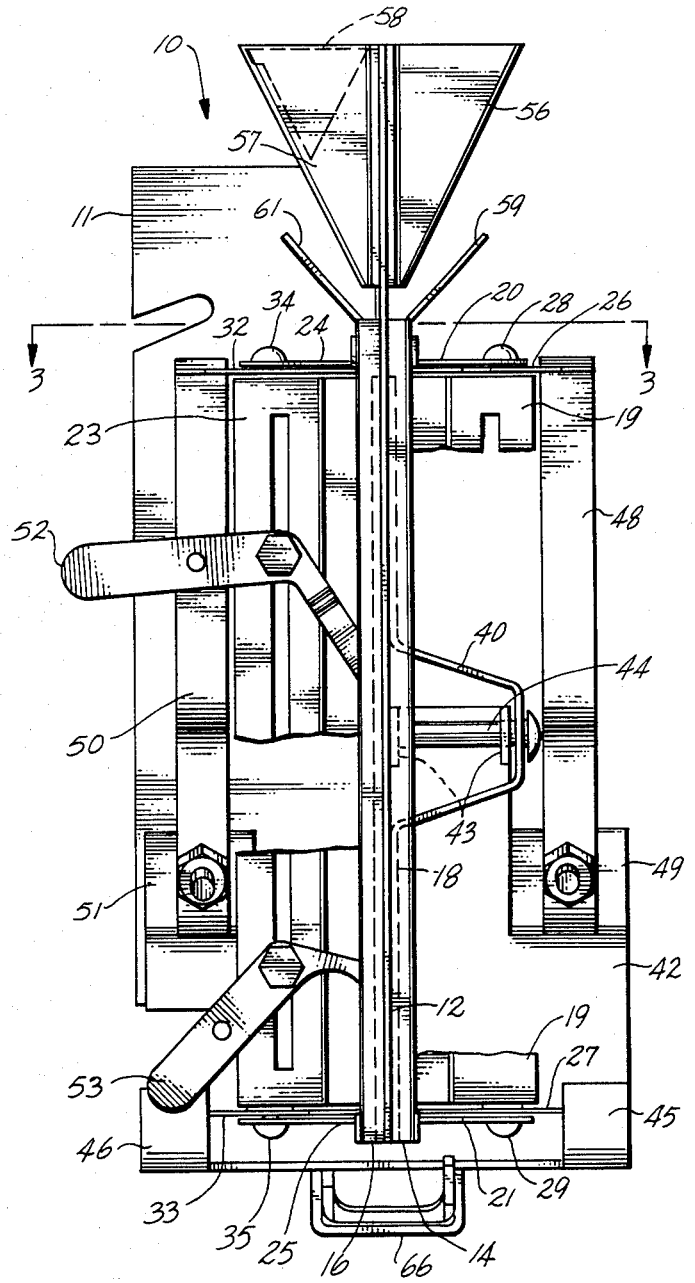
FIG. 1 is a front elevation view of a coin mechanism incorporating principles of the invention.

This invention is an improvement of the coin mechanism disclosed in Chalabian U.S. Pat. No. 3,884,330, which issued May 20, 1975. The disclosure of this patent is incorporated fully herein by reference.

In the drawings is shown a coin mechanism having a frame 10. Frame 10 is formed from a piece of sheet metal bent at right angles to form panels 11 and 12. Panel 11 is bolted on the inside of a front panel 13 of a newsrack. Panel 12 extends perpendicularly from front panel 13 and serves as a mounting surface for elongated coin chutes 14 and 16, which each have an approximately U-shaped cross section and a longitudinal slot 15. Specifically, a bracket 18 is fixedly secured on one side of panel 12 and a bracket 22 is fixedly secured on the other side of panel 12. Bracket 18 has a pawl guide 19 extending outwardly from panel 12 along the length of chute 14 and mounting extensions 20 and 21 adjacent to the top and bottom of chute 14, respectively. Bracket 22 has a pawl guide 23 extending outwardly from panel 12 along the length of chute 16 and mounting extensions 24 and 25 adjacent to the top and bottom of chute 14, respectively. Chute 14 has L-brackets 26 and 27 that are pivotally attached to mounting extensions 20 and 21, respectively, by pivot pins 28 and 29, respectively. Chute 16 has L-brackets 32 and 33 that are pivotally attached to mounting extensions 24 and 25, respectively, by pivot pins 34 and 35, respectively. Thus, chutes 14 and 16 are pivotally mounted on frame 10. When chutes 14 and 16 pivot in one direction, i.e., away from panel 12, they open, thereby releasing any coins in the chutes for delivery to a coin return receptacle, when chutes 14 and 16 pivot in the other direction, i.e., toward panel 12, they close.

Bracket 18 also has a U-shaped mounting extension 40 midway between extensions 20 and 21. An actuating lever 42 has at its upper extremity a yoke 43 by which it is pivotally mounted to frame 10 by a pivot pin 44 which passes through mounting extension 40, yoke 43 and panel 11. Strikers 45 and 46 formed at the bottom of actuating lever 42 engage L-brackets 27 and 33, respectively, when actuating lever 42 pivots in one direction, i.e., counterclockwise as viewed in FIG. 2, and disengage L-brackets 27 and 33, respectively, when actuating lever 42 pivots in the other direction, i.e., clockwise, as viewed in FIG. 2. When strikers 45 and 46 engage L-brackets 27 and 33, respectively, chutes 14 and 16, respectively, open, thereby releasing coins stored therein.

Figure 2:
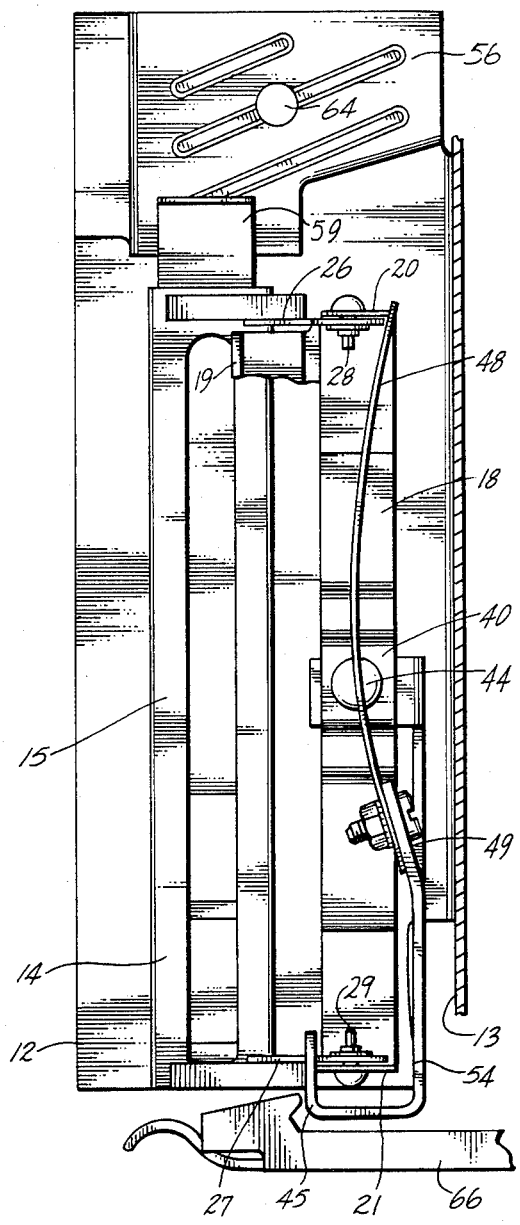
FIG. 2 is a side elevation view of the coin mechanism of FIG. 1.

One end of a leaf spring 48 is fixedly secured to a rigid angled plate 49, which forms part of actuating lever 42. The other end of leaf spring 48 bears against the extremity of L-bracket 26. Leaf spring 48 serves both to pivotally urge chute 14 toward panel 12 and to pivotally urge actuating lever 42 toward the back edge of panel 12 below panel 11, identified by reference numeral 54 (FIG. 2). Back edge 54 serves as a stop on the travel of actuating lever 42.

One end of a leaf spring 50 is fixedly secured to panel 11 by a rigid angled plate 51. The other end of spring 50 bears against the extremity of L-bracket 32 so as to pivotally urge chute 16 toward panel 12.

Springs 48 and 50 could be cut from a coiled length of blue clock spring. The angles of plates 49 and 51 are selected so springs 48 and 50 are in deformed condition at all times in planes parallel to panel 12 and they control the force exerted by springs 48 and 50, respectively. Springs 48 and 50 provide positive closing action for chutes 14 and 16 over a prolonged period of time because they do not tend to deform permanently as does a coil spring. Further, structural simplicity is realized by the use of spring 48, both to bias chute 14 and actuating lever 42.

Figure 3:
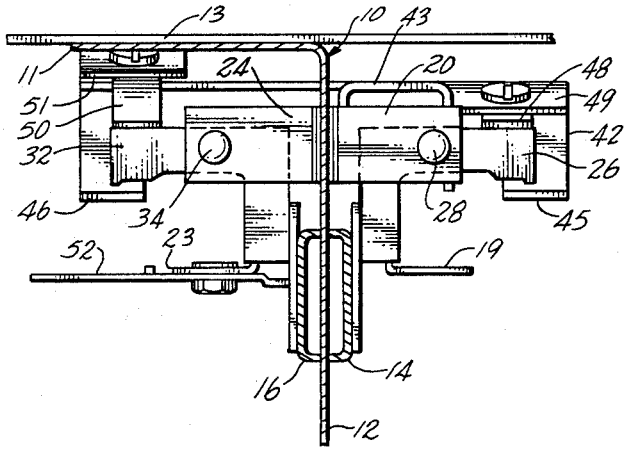
FIG. 3 is a top-sectional view of the coin mechanism of FIG. 1 taken through plane 3—3.
Figure 4:
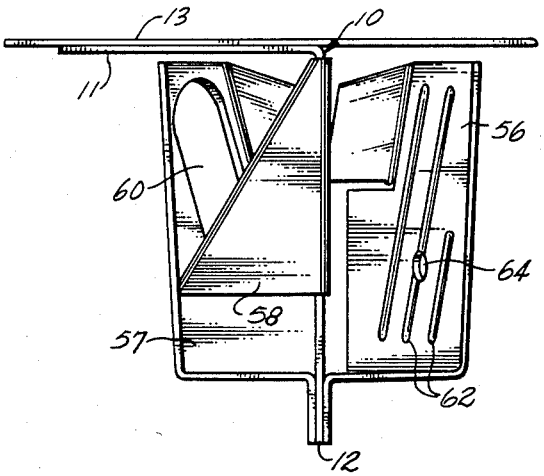
FIG. 4 is a top elevation view of the coin mechanism of FIG. 1.

It should be noted that in the referenced Chalabian patent, the leaf spring (101) for biasing the actuating lever (61) bears against a bracket (75), which is fixedly secured to the frame (71). A separate coil spring (105) is used to urge the coin chutes (85,87) closed. The ends of the coil spring are connected to brackets (79) that are affixed to the respective chutes. The coil spring is eliminated, according to the present invention, by moving the leaf spring laterally, i.e., to the right as viewed in FIG. 1, so that the leaf spring bears against a bracket affixed to the coin chute, i.e., in the specific embodiment disclosed herein, L-bracket 26. This is best illustrated in FIGS. 1 and 3.

Pawls 52 and 53 are mounted at specified points on pawl guide 19 and/or 23 in the manner described in the referenced Chalabian patent to fix the proper coinage that unlocks the access door of the newsrack. The front panel of the newsrack has coin slots opening into coin funnels 56 and 57 above chutes 14 and 16, respectively. The bottoms of funnels 56 and 57 open to the tops of chutes 14 and 16, respectively, which are flared at 59 and 61 to insure proper coupling of coins from funnels 56 and 67 to chutes 14 and 16, respectively. A penny-rejecting deflector 58, which is fixedly secured to panel 12, extends into the interior of funnel 57. Funnel 57 has an opening 60 in its side wall through which pennies are shunted to a coin return receptacle of the newsrack by deflector 58. The interior of funnel 56 has several parallel elongated ridges 62 to prevent moisture from impeding passage of coins in funnel 56. An opening 64 locates the stock from which funnel 56 is formed during the die pressing operation.

A coin changeover linkage (not shown) could be mounted on the front edge of panel 12. Such a linkage is shown in co-pending application Ser. No. 168,007, filed July 14, 1980, and assigned to the assignee of the present application. The disclosure of this application is incorporated fully herein by reference.

In operation, the described coin mechanism operates with a pivotal, upwardly biased latch 66 substantially in the manner described in the referenced Chalabian patent. Latch 66 passes under chutes 14 and 16 as the access door of the newsrack is pulled. Preferably, latch 66 is constructed and attached to the access door of the newsrack in the manner described in co-pending application Ser. No. 168,017, filed July 14, 1980, and assigned to the assignee of the present application. The disclosure of this application is incorporated fully herein by reference. Briefly, in the absence of the proper coinage in chutes 14 and 16, the coins therein move up as latch 66 passes under. As a result, actuating lever 42 lies in the path of latch 66 as the access door of the newsrack is pulled in an attempt to open it; latch 66 pulls actuating lever 42, thereby pivoting it in a counterclockwise direction as viewed in FIG. 2, which opens chutes 14 and 16. Thus, the coins in chutes 14 and 16 are delivered to the coin return receptacle of the newsrack. Latch 66 continues to pull actuating lever 42 until it abuts front panel 13, at which point further movement of actuating lever 42, latch 66, and, thus, the access door is inhibited. In the presence of the proper coinage in chutes 14 and 16, the pawls prevent upward movement of the coins in chutes 14 and 16. Thus, as latch 66 passes across the coins at the bottom of the chutes, it is pivoted downwardly out of the path of actuating lever 42. In this case, the access door can be opened as it is pulled, chutes 14 and 16 remain closed, and, after latch 66 clears the bottom of chutes 14 and 16, the coins therein are delivered to the coin box of the newsrack.

Figure 5:
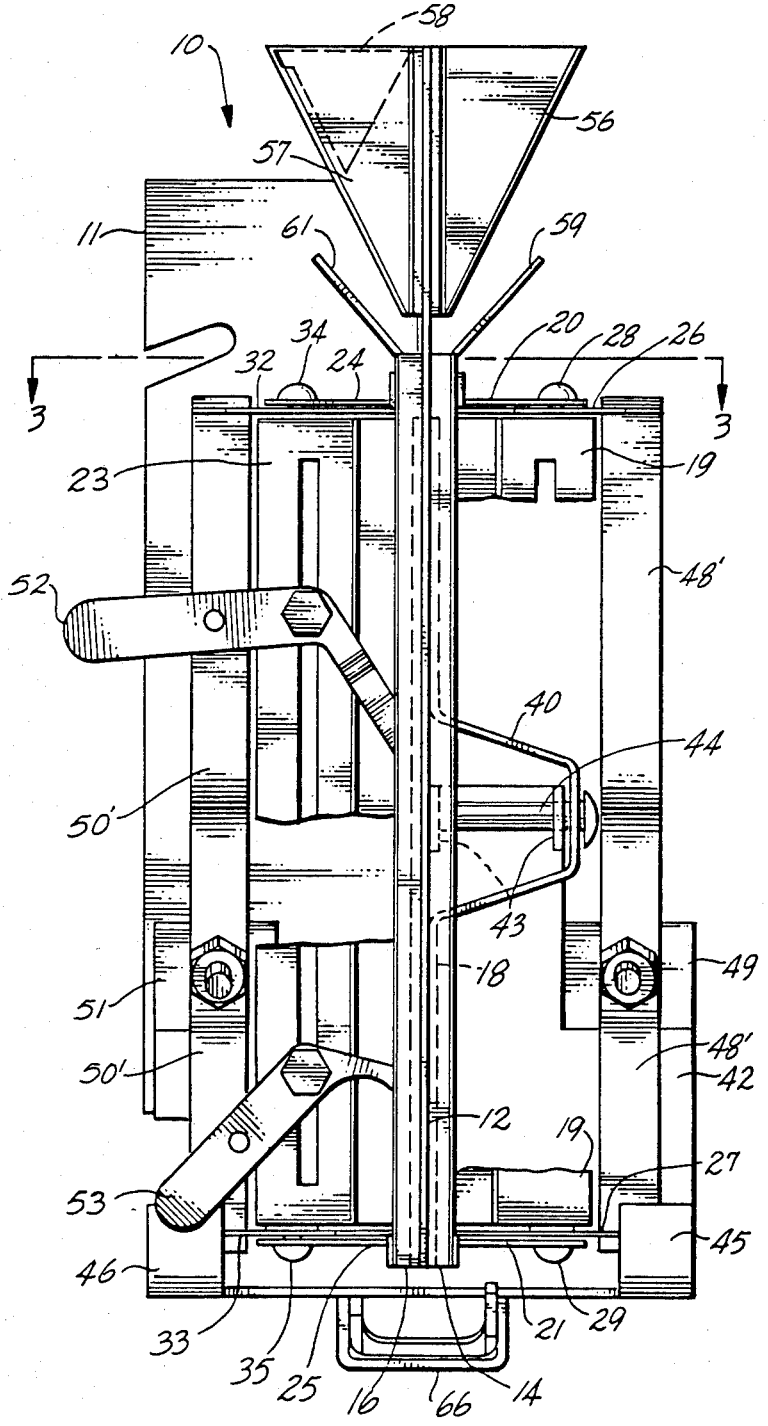
FIG. 5 is a front elevation view of a modification of the coin mechanism of FIG. 1.
Figure 6:
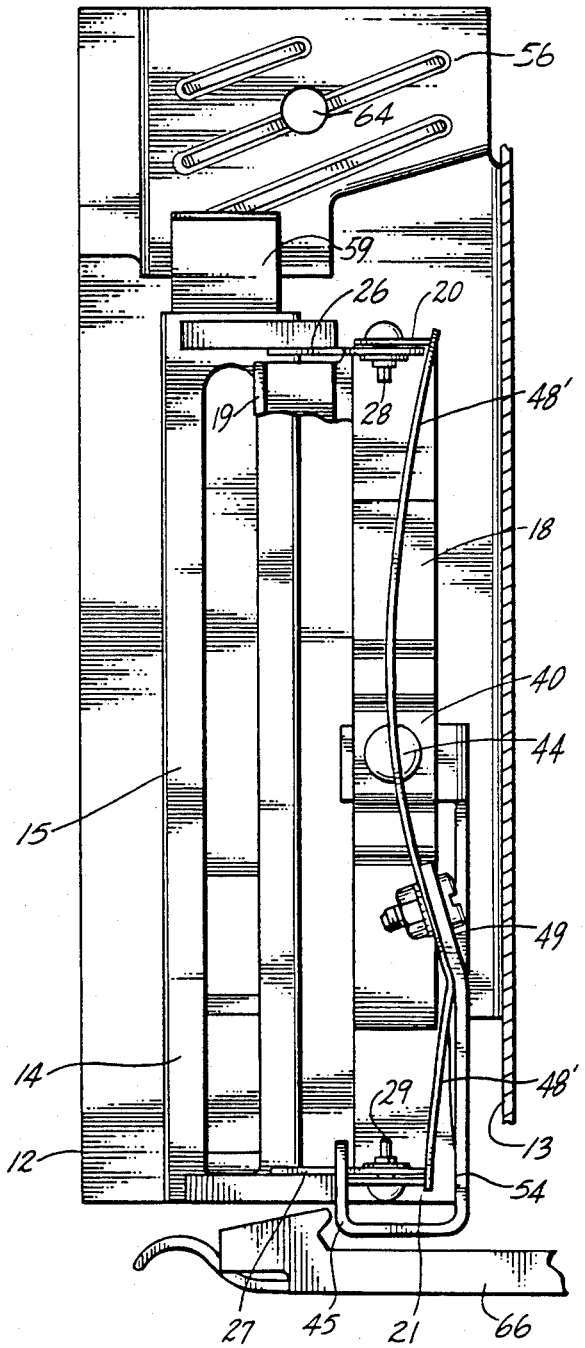
FIG. 6 is a side elevation view of the modification of FIG. 5.

FIGS. 5 and 6 show a modification of the described coin mechanism according to which leaf springs 48' and 50' are substituted for leaf springs 48 and 50. Otherwise, the coin mechanism of FIGS. 5 and 6 is identical to that of FIGS. 1 through 4. One end of leaf spring 48' bears against the extremity of L-bracket 26 and the other end thereof bears against the extremity of L-bracket 27, leaf spring 48' being fixedly secured to angle plate 49 at a point between its ends. Similarly, one end of leaf spring 50' bears against the extremity of L-bracket 32 and the other end thereof bears against the extremity of L-bracket 33, leaf spring 50' being fixedly secured to panel 11 by plate 51 at a point between its ends. Thus, chutes 14 and 16 are biased closed at both ends by leaf springs 48' and 50', respectively, thereby improving the closing action of chutes 14 and 16. The return of actuating lever 42 to its stop, i.e., back edge 54, is also facilitated by the application of reactive force thereto from both ends of leaf spring 48'. It should be noted that, whereas the top of each of springs 48' and 50' is straight in its undeformed condition, there is a permanent rearward bend in each of springs 48' and 50' below the point of attachment to plate 49 and plate 51, respectively, as illustrated in FIG. 6, so that the ends of springs 48' and 50' bearing against L-brackets 27 and 33, respectively, are in elastically deformed condition at all times.

The described embodiments of the invention are only considered to be preferred and illustrative of the inventive concept; the scope of the invention is not to be restricted to such embodiments. Various and numerous other arrangements may be devised by one skilled in the art without departing from the spirit and scope of this invention.

What is claimed is:

1. A coin mechanism comprising:

a stationary frame;

a pair of coin chutes pivotally mounted on the frame, the chutes pivoting open in one direction and closed in the other direction;

an actuating lever pivotally mounted on the frame such that it pivots in one direction to engage and open the chutes and pivots in the other direction to disengage the chutes;

means for spring biasing one of the chutes in the other direction to urge the one chute closed; and a spring extending between the other chute and the actuating lever to bias the other chute in the other direction and to bias the actuating lever in the other direction.

2. The coin mechanism of claim 1, in which the spring is a leaf spring.

3. The coin mechanism of claim 2, in which the spring biasing means is a leaf spring.

4. The coin mechanism of claim 1, in which the frame is formed from a piece of sheet metal bent at right angles to form first and second panels, the chutes pivot into abutment with opposite surfaces of the first panel when closed, each coin chute has a bracket with an extremity extending transversely from the first panel, and the actuating lever pivots about an axis transverse to the first panel.

5. The coin mechanism of claim 4, in which the spring is a leaf spring deformed in a plane parallel to the first panel, one of the ends of the leaf spring bears against the actuating lever and the other end of the leaf spring bears against the extremity of the bracket for the other chute.

6. The coin mechanism of claim 5, in which the actuating lever has a rigid angled plate and the end of the leaf spring bearing against the actuating lever is fixedly secured to the angled plate.

7. The coin mechanism of claim 6, in which the spring biasing means is a leaf spring deformed in a plane parallel to the first panel, one end of the last named leaf spring bearing against the second panel and the other end thereof bearing against the extremity of the bracket for the one chute.

8. The coin mechanism of claim 7, additionally comprising a rigid angled plate fixed to the second panel, the end of the last named leaf spring bearing against the second panel being fixedly secured to the last named angled plate.

9. The coin mechanism of claim 4, in which the spring biasing means is a leaf spring deformed in a plane parallel to the first panel, one end of the leaf spring bearing against the second panel and the other end of the leaf spring bearing against the extremity of the bracket for the one chute.

10. The coin mechanism of claim 9, additionally comprising a rigid angled plate fixed to the second panel, the end of the leaf spring bearing against the second panel being fixedly secured to the angled plate.

11. A coin mechanism comprising:

a stationary frame;

a pair of coin chutes pivotally mounted on the frame, the chutes pivoting open in one direction and closed in the other direction;

first and second brackets formed at the respective ends of one of the chutes;

an actuating lever pivotally mounted on the frame such that it pivots in one direction to engage the first bracket and open the one chute and pivots in the other direction to disengage the first bracket;

a leaf spring;

means for securing the leaf spring to the actuating lever at a point between its ends such that one end of the leaf spring bears against the first bracket and the other end of the leaf spring bears against the second bracket to bias the one chute in the other direction to urge the one chute closed; and means for spring biasing the other chute in the other direction to urge the other chute closed.

12. The coin mechanism of claim 11, in which the biasing means comprises third and fourth brackets formed at the respective ends of the other coin chute, an additional leaf spring, and means for securing the additional leaf spring at a point between its ends such that one end bears against the third bracket and the other end bears against the second bracket to bias the other chute in the other direction to urge the other chute closed.

13. The coin mechanism of claim 12, in which the actuating lever also engages the third bracket when it pivots in the one direction and disengages the third bracket when it pivots in the other direction.

14. The coin mechanism of claim 13, in which the additional leaf spring is secured to the frame.

* * * * *